US010665382B2

(12) United States Patent
Miyamoto et al.

(10) Patent No.: US 10,665,382 B2
(45) Date of Patent: May 26, 2020

(54) STATIONARY INDUCTION APPARATUS

(71) Applicant: Hitachi, Ltd., Chiyoda-ku, Tokyo (JP)

(72) Inventors: Naoya Miyamoto, Tokyo (JP); Yoshio Hamadate, Tokyo (JP); Akira Yamagishi, Tokyo (JP); Mao Kawamoto, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 182 days.

(21) Appl. No.: 15/850,206

(22) Filed: Dec. 21, 2017

(65) Prior Publication Data

US 2018/0204670 A1 Jul. 19, 2018

(30) Foreign Application Priority Data

Jan. 19, 2017 (JP) ..... 2017-007159

(51) Int. Cl.

| | |
|---|---|
| ***H01F 27/36*** | (2006.01) |
| ***H01F 27/34*** | (2006.01) |
| ***H01F 27/06*** | (2006.01) |
| ***H01F 27/02*** | (2006.01) |
| ***H01F 3/14*** | (2006.01) |
| ***H01F 27/28*** | (2006.01) |

(Continued)

(52) U.S. Cl.

CPC ..... *H01F 27/343* (2013.01); *H01F 3/14* (2013.01); *H01F 27/025* (2013.01); *H01F 27/06* (2013.01); *H01F 27/289* (2013.01); *H01F 27/2885* (2013.01); *H01F 27/323* (2013.01); *H01F 27/324* (2013.01); *H01F 27/362* (2013.01); *H01F 27/12* (2013.01); *H01F 27/346* (2013.01)

(58) Field of Classification Search

CPC ..... H01F 27/343; H01F 27/06; H01F 27/025; H01F 3/14; H01F 27/289; H01F 27/323; H01F 27/12

USPC ..... 336/84 R, 84 C, 84 M, 196, 197

See application file for complete search history.

(56) References Cited

U.S. PATENT DOCUMENTS 2,988,840 A * 6/1961 Seigle ..... A01K 93/02 43/17
2,998,840 A * 9/1961 Davis ..... H01F 1/26 428/189

(Continued)

FOREIGN PATENT DOCUMENTS

JP 52068919 A * 6/1977
JP 54021529 A * 2/1979

(Continued)

*Primary Examiner* — Tszfung J Chan
(74) *Attorney, Agent, or Firm* — Crowell & Moring LLP

(57) ABSTRACT

A stationary induction apparatus includes a main body tank and a stationary induction apparatus main body. The main body is accommodated in the tank. An electrostatic shield ring is placed on the upper and lower end parts of a winding. An electrostatic shield ring has a magnetic ring and two insulating rings vertically fixing the magnetic ring for a spool. A conductive tape is laid on an insulating tape. These tapes are wound around the spool. An insulating tape is wound around the wound tapes. The width of the insulating tape is equal to or greater than the width of the conductive tape. One end of the conductive tape is connected to one end part of the winding and to the magnetic ring. A gap is provided at at least one place on the magnetic ring. The winding direction of the conductive tape is inverted at at least one place.

17 Claims, 5 Drawing Sheets

(51) Int. Cl.
*H01F 27/32* (2006.01)
*H01F 27/12* (2006.01)

(56) References Cited

U.S. PATENT DOCUMENTS 3,750,070 A * 7/1973 Rissinger ..... H01F 27/303
336/84 R
3,983,523 A * 9/1976 Ayers ..... H01F 27/362
336/84 R

FOREIGN PATENT DOCUMENTS

JP 04103115 A * 4/1992
JP 8-288153 A 11/1996

* cited by examiner

STATIONARY INDUCTION APPARATUS

BACKGROUND

The present invention relates to a stationary induction apparatus such as a transformer and a reactor.

In stationary induction apparatuses such as transformers and reactors, when a circuit connected to a stationary induction apparatus is short-circuited, a large short-circuit current is carried through windings configuring the main body of the apparatus, a leakage flux generated due to the short-circuit current is linked with the winding short-circuit current, and thus a large electromagnetic force is applied to the windings. Because of the electromagnetic force application, the stationary induction apparatus is designed so that the windings can withstand the electromagnetic force. With an increase in the capacity of the apparatus, an increase in the electromagnetic force that the stationary induction apparatus has to withstand causes the difficulty of narrowing electric wires with continuously transposed conductors, and this creates problems such as a cost increase due to widened electric wires and an increase in eddy current losses in the windings. Therefore, a wide variety of methods that decrease the amount of materials of electric wires is adopted, including a method that uses half annealed copper wires for electric wire materials instead of typical annealed copper wires and a method that uses a continuously transposed conductor coated with a thermosetting resin in which the coated conductor is wound, heated, and then hardened. These methods adopt methods that reinforce the strength of electric wires using the physical properties of electric wire materials and resins. However, the methods fail to decrease the strength itself that has to be required.

Therefore, Japanese Unexamined Patent Application Publication No. Hei 8-288153, for example, discloses a stationary induction apparatus. In the apparatus, a magnetic ring configured of a magnetic substance is placed at the end parts of windings or near the region around a tap center, the orientation of a leakage flux is changed from the winding radial direction to the winding axial direction, and this enables the orientation of the electromagnetic force applied to the windings to be changed from the winding axial direction to the winding radial direction. The electromagnetic force in the winding radial direction is more easily supportable than the electromagnetic force in the winding axial direction, and this enables a reduction in the cross sectional area of electric wires. At the place where the orientation of the magnetic flux has been changed due to the magnetic ring, eddy current losses produced in the windings are deceased. Placing the magnetic ring in a shield ring reduces an increase in size that is due to the distance of insulation.

SUMMARY

The stationary induction apparatus desirably has a small size and low losses while the apparatus is practically designed based on required specifications.

The stationary induction apparatus described in Japanese Unexamined Patent Application Publication No. Hei 8-288153 has the effect that enables a reduction in the cross sectional area of electric wires by placing the magnetic ring at the end parts of the windings to direct the orientation of the leakage flux at the end parts of the windings to the winding axial direction, the effect that enables a reduction in eddy current losses at the end parts of the windings, and the effect that reduces an increase in the distance of insulation between the winding and the iron core yoke by accommodating the magnetic ring placed at the end part of the winding in the shield ring. However, the magnetic flux converged on the magnetic ring in the shield ring is linked with an electrostatic shield conducting ring similarly configuring the shield ring, and this causes eddy current losses in the electrostatic shield conducting ring. Thus, the effect of reducing losses is limited in the entire stationary induction apparatus, and a local temperature rise is possibly observed at the electrostatic shield conducting ring.

Therefore, an object of the present invention is to provide a stationary induction apparatus that reduces mechanical force in the axial direction of a winding, the mechanical force generated in the winding, that reduces the cross sectional area of an electric wire, that reduces eddy current losses at the end part of the winding, that provides no increase in the distance between the winding and an iron core yoke, and that reduces eddy current losses in an electrostatic shield ring.

In order to solve the problem, a stationary induction apparatus according to an aspect of the present invention includes a main body tank, and a stationary induction apparatus main body including an iron core having at least two legs and a winding individually wound around each of the legs. In the apparatus, the stationary induction apparatus main body is accommodated in the main body tank. An insulating cooling medium is sealed in the main body tank, and the stationary induction apparatus main body is immersed in the insulating cooling medium. The iron core is fastened and fixed with an upper iron-core fastener and a lower iron-core fastener. An insulating winding support is provided between the upper iron-core fastener and the winding and between the lower iron-core fastener and the winding. An electrostatic shield ring is provided on at least one of an upper end part and a lower end part of the winding. The winding and the electrostatic shield ring are fixed with the upper iron-core fastener or the lower iron-core fastener and the winding support. A magnetic ring configured of a magnetic substance is provided inside the electrostatic shield ring. The electrostatic shield ring is configured in a manner that a conductive layer is provided to cover the magnetic ring. The conductive layer is configured using a conductive tape wound around the magnetic ring. In winding the conductive tape, an insulating tape having a width equal to or greater than a width of the conductive tape is laid on an inner side of the conductive tape, and the insulating tape and the conductive tape are wound together.

According to the present invention, a reduction in the required winding strength is enabled with regard to the electromagnetic force that is generated on the winding when a short-circuit current is carried through the stationary induction apparatus, a reduction in the size of the apparatus main body is enabled, and a reduction in losses in the winding and a reduction in losses in the electrostatic shield ring are enabled, achieving a cost reduction and a reduction in losses.

DETAILED DESCRIPTION

A stationary induction apparatus according to an embodiment of the present invention includes a main body tank, and a stationary induction apparatus main body including an iron core having at least two legs and a winding individually wound around each of the legs. In the apparatus, the stationary induction apparatus main body is accommodated in the main body tank. An insulating cooling medium is sealed in the main body tank, and the stationary induction apparatus main body is immersed in the insulating cooling medium. The iron core is fastened and fixed with an upper iron-core fastener and a lower iron-core fastener. An insulating winding support is provided between the upper iron-core fastener and the winding and between the lower iron-core fastener and the winding. An electrostatic shield ring is provided on at least one of an upper end part and a lower end part of the winding. The winding and the electrostatic shield ring are fixed with the upper iron-core fastener or the lower iron-core fastener and the winding support. A magnetic ring configured of a magnetic substance is provided inside the electrostatic shield ring. The electrostatic shield ring is configured in a manner that a conductive layer is provided to cover the magnetic ring. The conductive layer is configured using a conductive tape wound around the magnetic ring. In winding the conductive tape, an insulating tape having a width equal to or greater than a width of the conductive tape is laid on an inner side of the conductive tape, and the insulating tape and the conductive tape are wound together. With this configuration, a stationary induction apparatus is achieved, the apparatus with which the insulation between the turns of the conductive tape is removed to achieve a conductive layer having a small magnetic flux linked area for reducing eddy current losses, the winding direction of the conductive tape is changed in the process of winding the conductive tape to reduce the induced electromotive force that is induced on the conductive tape, and an electric current in the conductive tape is reduced, the electric current produced due to the induced electromotive force when unexpected electrical continuity is produced. Thus, the stationary induction apparatus reduces mechanical force in the axial direction that is produced in the winding, reduces the amount of materials of electric wire, reduces eddy current losses at the end part of the winding, reduces eddy current losses in the electrostatic shield ring, and provides no increase in the distance between the winding and the iron core yoke.

In the following, a preferred embodiment of the present invention will be described with reference to the drawings. The embodiment below is merely an example that will not limit the embodiment of the present invention.

First Embodiment

Figure 1:
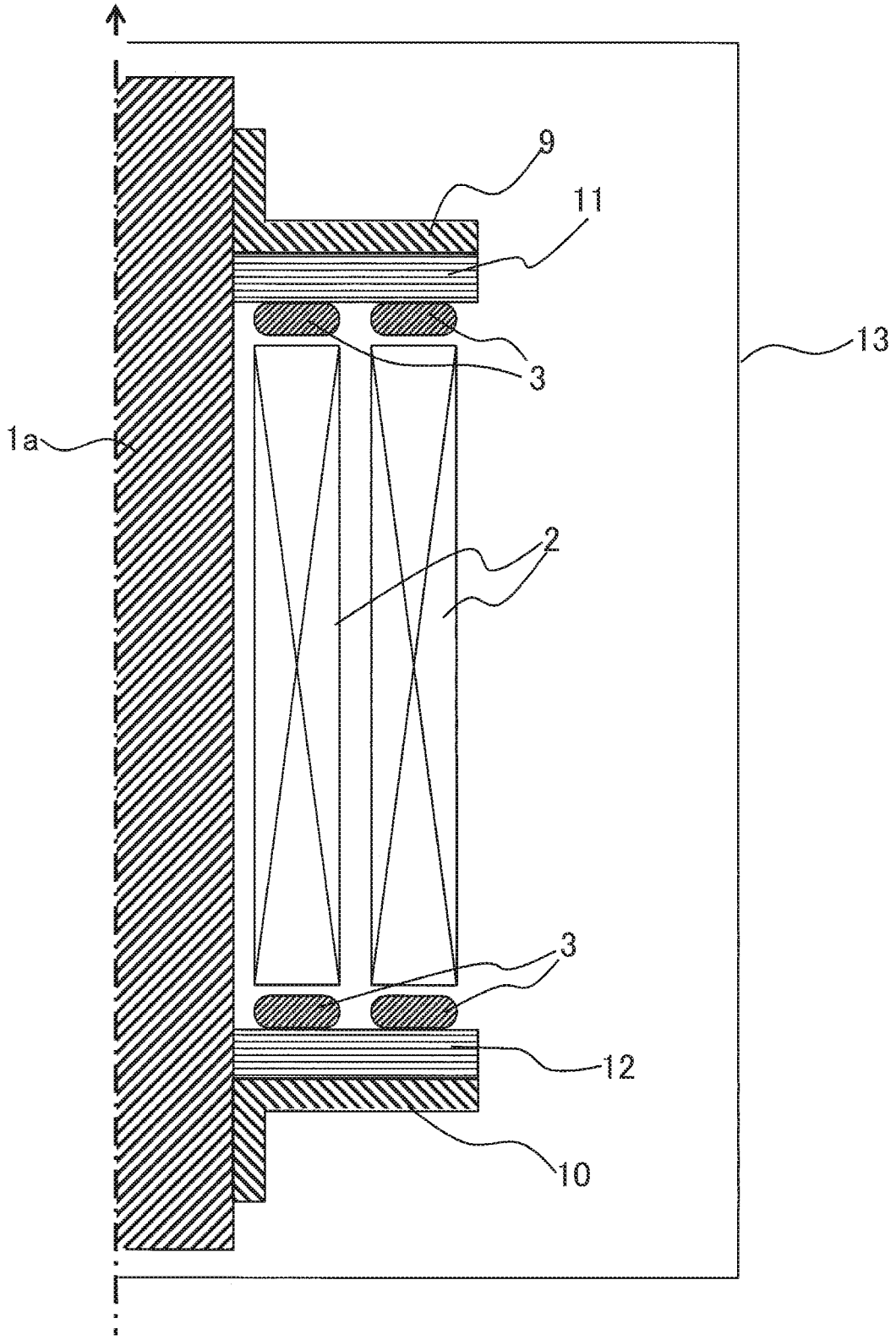
FIG. 1 is a view of a cross sectional configuration of a transformer according to an embodiment.

FIG. 1 illustrates the overall structure of a stationary induction apparatus. The stationary induction apparatus includes a main body tank 13 and a stationary induction apparatus main body having an iron core with a leg 1 and a winding 2 wound around the leg 1*a*. The stationary induction apparatus main body is accommodated in the main body tank 13. An insulating cooling medium is sealed in the main body tank 13, and the stationary induction apparatus main body is immersed in the insulating cooling medium.

A cross sectional view of the configuration of the stationary induction apparatus main body in FIG. 1 illustrates the arrangement of one leg 1*a*, the winding 2 wound around the leg 1*a*, an upper iron-core fastener 9, a lower iron-core fastener 10, and a winding upper support 11 and a winding lower support 12 respectively disposed above and below the winding. Actually, the stationary induction apparatus main body possibly has at least two legs, and possibly has a single-phase two-leg configuration, a single-phase three-leg configuration, a three-phase three-leg configuration, and a three-phase five-leg configuration, for example.

The upper and lower parts of the iron core are respectively fastened and fixed with the upper iron-core fastener 9 and the lower iron-core fastener 10. The winding upper support 11 is disposed above the winding 2, and the winding lower support 12 is disposed below the winding 2. The electrostatic shield ring 3 is disposed between the winding 2 and the winding upper support 11 or between the winding 2 and the winding lower support 12. The winding 2 and the electrostatic shield ring 3 are vertically fixed with the winding upper support 11 and the winding lower support 12.

Figure 2:
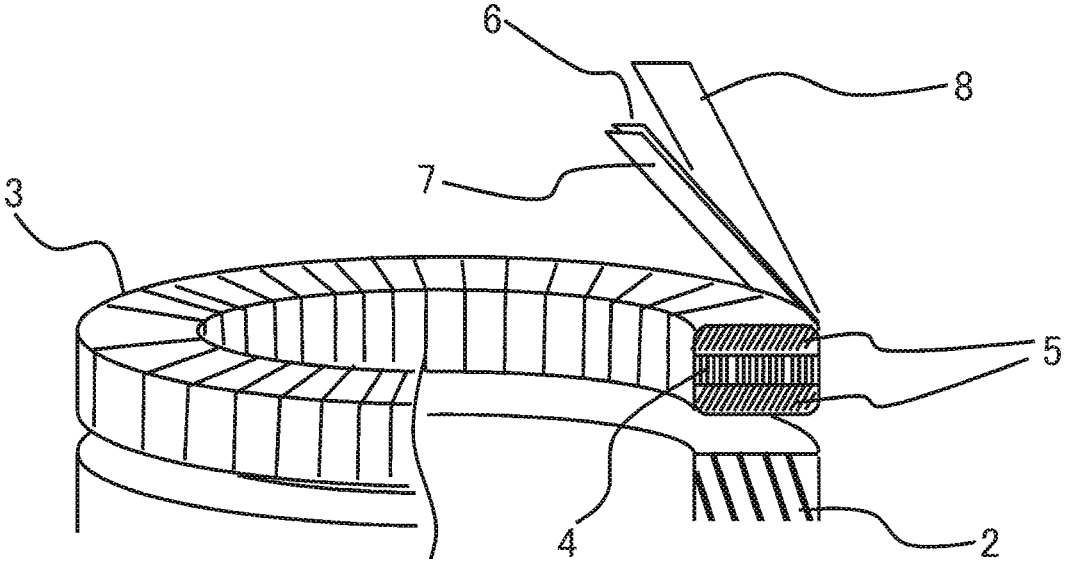
FIG. 2 is a view of the configuration of an electrostatic shield ring provided above a winding in FIG. 1, illustrating a cross sectional view of the main parts of the transformer.
Figure 6:
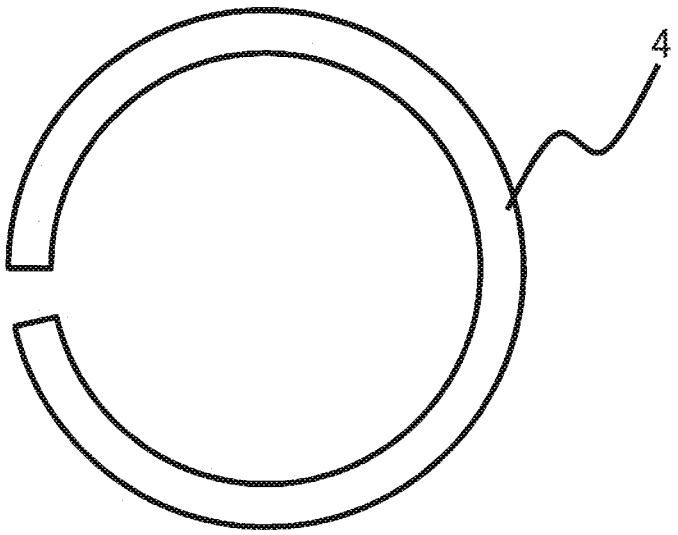
FIG. 6 is a diagram illustrating an exemplary gap provided on the circumference of a magnetic ring in FIG. 2.

The embodiment is specifically applied to the structure of the electrostatic shield ring 3 in FIG. 1. As illustrated in FIG. 2, the electrostatic shield ring 3 is disposed above the winding 2. The electrostatic shield ring 3 includes a magnetic ring 4 and two insulating rings 5 vertically fixing the magnetic ring 4. These rings 4 and 5 are used as ring-shaped core materials for a spool. A conductive tape 6 is laid on the outer side of an insulating tape 7, which is laid on the inner side of the conductive tape 6, and these tapes 6 and 7 are wound around the spool. An outer insulating tape 8 is wound around on the outer side of the tape 6. The width of the insulating tape 7 is equal to or greater than the width of the conductive tape 6. The conductive tape 6 is connected at the end part of the winding 2 and the magnetic ring 4 at a given place (not shown). The conductive tape 6, the winding 2, and the magnetic ring 4 have equal potentials to have the function of electrostatic shielding. The other end part of the conductive tape 6, which is unconnected, is insulted. As illustrated in FIG. 6, a gap is provided on the magnetic ring 4 at at least one place in the circumferential direction for preventing an electric current from being carried through the magnetic ring 4 in carrying a magnetic flux through the leg 1*a*. FIG. 2 illustrates the case where the electrostatic shield ring 3 is disposed above the winding 2, and the electrostatic shield ring 3 disposed below the winding 2 is similarly configured.

Figure 3:
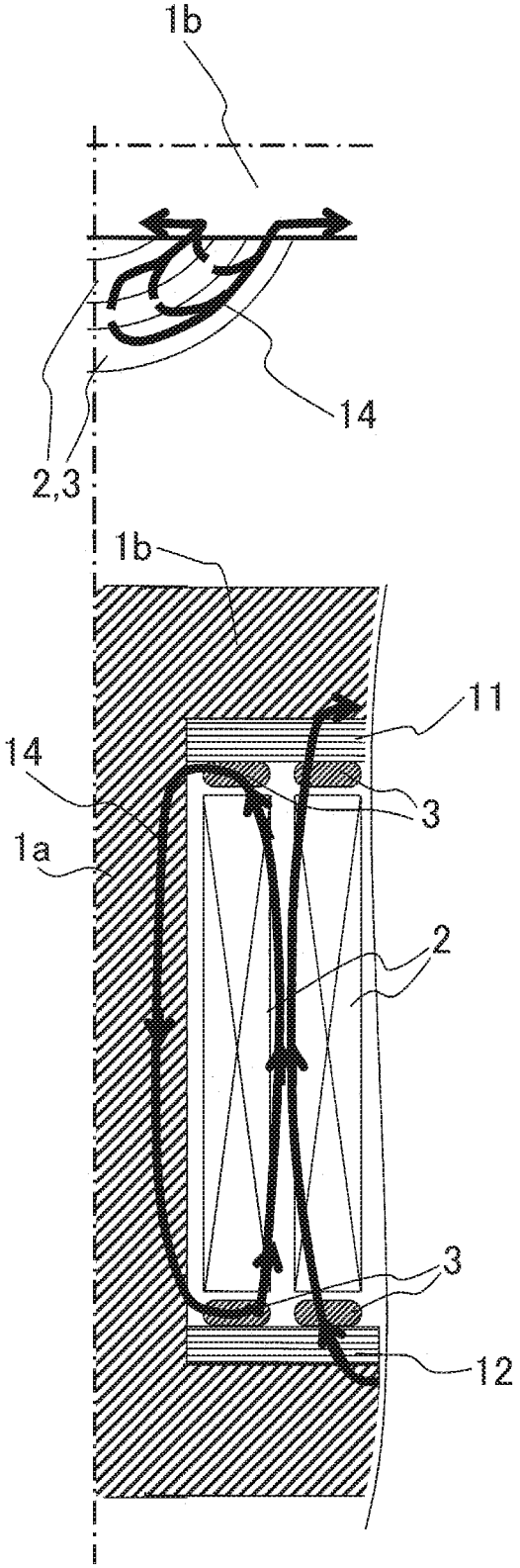
FIG. 3 is a diagram schematically illustrating leakage fluxes in the transformer in the embodiment.
Figure 4:
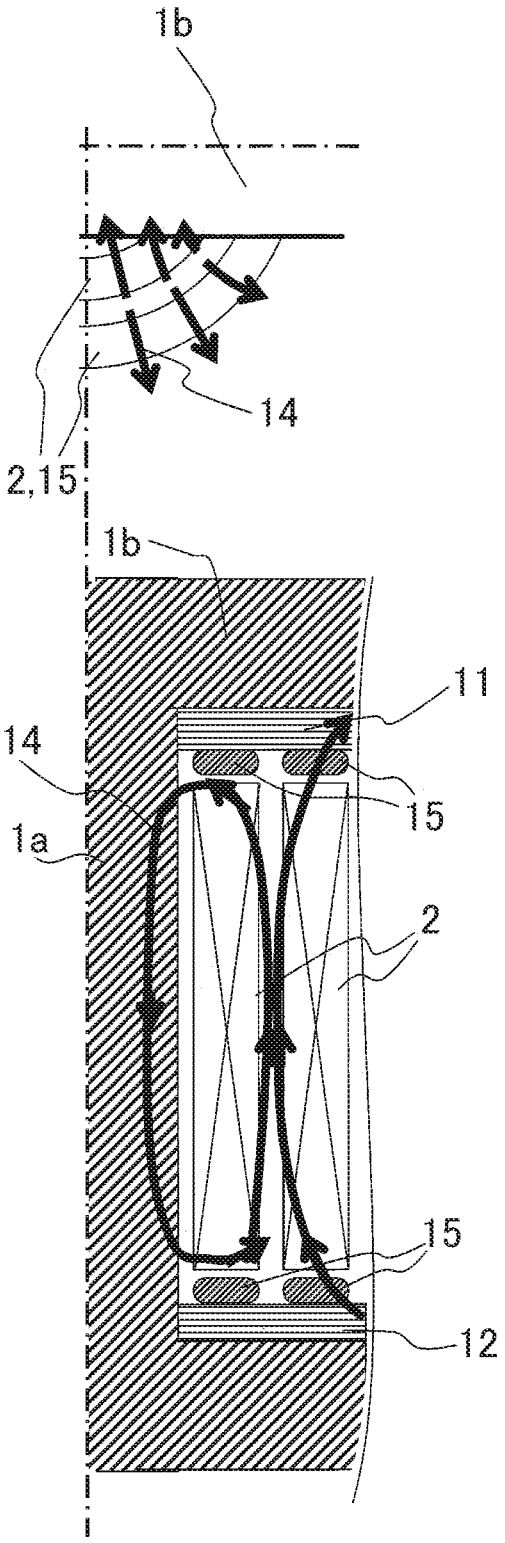
FIG. 4 is a diagram schematically illustrating leakage fluxes in a previously existing transformer.

The effect of the embodiment will be described with reference to FIGS. 2, 3, and 4. As an exemplary configuration of a previously existing stationary induction apparatus, in the case where an electrostatic shield ring is a nonmagnetic shield ring having no magnetic substance as illustrated in FIG. 4, leakage fluxes 14 cross the end part of the winding 2 in the winding radial direction in an almost radial spread, and flow through the leg 1*a* and the iron core yoke 1*b* to the space. In the embodiment, as illustrated in FIG. 3, the main flow of leakage fluxes 14 passes the end part of the winding 2 in almost the winding axial direction, enters the electrostatic shield ring 3, flows through the inside of the electrostatic shield ring 3 in the winding circumferential direction, and flows through the leg 1*a* or the iron core yoke 1*b*. In the embodiment, the leakage fluxes 14 passing the end part of the winding 2 are mainly directed to the winding axial direction, and this directs the main orientation of the electromagnetic force, which is determined by the outer product of the electric current and the magnetic flux, to the winding radial direction. This enables the support of the electromagnetic force in the winding radial direction that is easier than the support of the electromagnetic force in the winding axial direction, which affects the entire winding 2, achieving a reduction in the cross sectional area of the electric wire. The electric wire typically has a rectangular cross section, and the length in the winding axial direction is longer than the length in the winding radial direction. Thus, according to the embodiment, directing the main orientation of the leakage fluxes 14 passing the end part of the winding to the winding axial direction enables a reduction in eddy current losses at the end part of the winding 2.

As illustrated in FIG. 3, in the embodiment, the leakage fluxes 14 pass the lower wide face of the electrostatic shield ring 3, gather in the electrostatic shield ring 3, pass the upper wide face of the electrostatic shield ring 3, and then go to the leg 1*a* or the iron core yoke 1*b*. Thus, these flows of the leakage fluxes 14 are likely to increase eddy current losses generated in the conductive layer provided on the outer side of the electrostatic shield ring more than an increase in a previously existing nonmagnetic electrostatic shield ring 15. However, the conductive layer is configured of the conductive tape 6 like the embodiment of the present invention, the insulating tape 7 is laid on the inner side of the conductive tape 6, and the tapes 6 and 7 are wound around the magnetic ring 4 and the insulating rings 5. This eliminates the insulation between the turns of the conductive tape 6, reducing the linked area when the leakage fluxes 14 come in and go out of the electrostatic shield ring 3. Thus, this enables a reduction in eddy current losses generated in the electrostatic shield ring 3.

The embodiment is configured in which the conductive tape 6 wound around the magnetic ring 4 and the insulating rings 5 is the winding and the magnetic ring 4 is the iron core with respect to the flow of the leakage fluxes 14. Thus, the leakage fluxes 14 generate the induced electromotive force between the turns of the conductive tape 6. When the number of turns of the conductive tape 6 is large, the potential is high at the unconnected end of the conductive tape 6. When the number of turns is a few hundred turns, for example, the case is also likely to be assumed in which the potential at the non-grounded end is the order of kilovolt.

Figure 5:
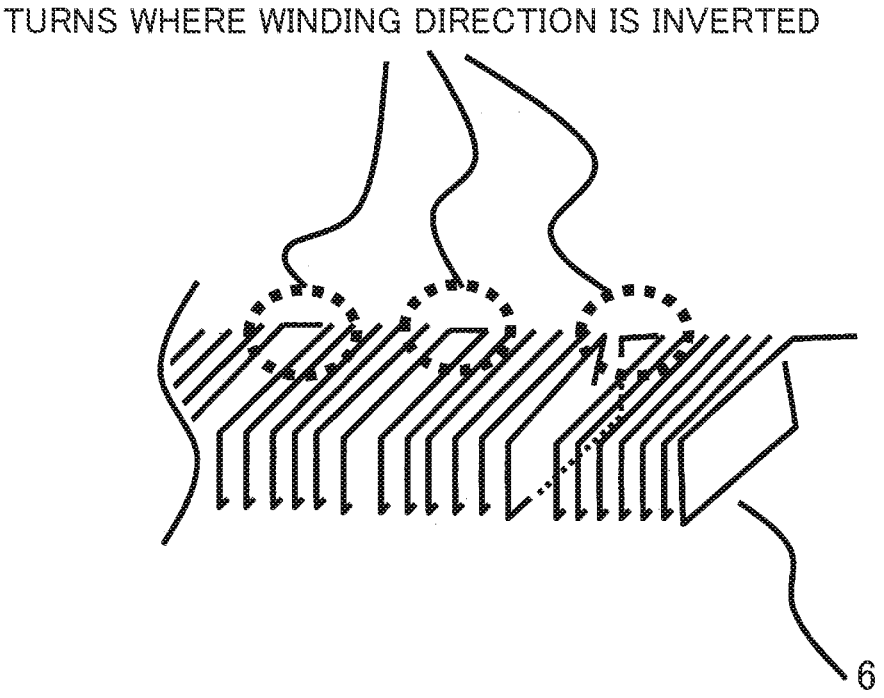
FIG. 5 is a schematic diagram illustrating an example how to wind a conductive tape around the electrostatic shield ring in FIG. 2.

In the embodiment, in the case where such a potential causes a problem, the winding direction of the conductive tape 6 is inverted in the midway point as illustrated in FIG. 5. This reduces the induced electromotive force due to leakage fluxes. Note that, in winding the inverted conductive tape, the insulating tape having a width equal to or greater than the width of the conductive tape is laid on the inner side of the inverted conductive tape, and the insulating tape and the conductive tape are wound together. The conductive tape may be inverted at every turn. The configuration in FIG. 5 enables a reduction in electric currents that are carried when electricity is unintentionally conducted between multiple turns of the conductive tape 6 through the magnetic ring 4, and also enables a reduction in losses.

As described above, according to the embodiment, a reduction in the required winding strength is enabled with regard to the electromagnetic force that is generated on the winding when a short-circuit current is carried through the stationary induction apparatus, a reduction in the size of the apparatus main body is enabled, and a reduction in losses in the winding and a reduction in losses in the electrostatic shield ring are enabled, achieving a cost reduction and a reduction in losses.

Note that, the present invention is not limited to the foregoing embodiment, and includes various exemplary modifications and alterations. For example, the foregoing embodiment is described in detail for easily understanding the present invention, and is a non-limiting embodiment that does not have to include all the configurations described above. A part of the configuration of an embodiment may be replaceable with the configuration of another embodiment, and the configuration of an embodiment may include the addition of the configuration of another embodiment. A part of the configuration of an embodiment may be added to, removed from, or replaced with another configuration.

What is claimed is:

1. A stationary induction apparatus comprising:

a main body tank; and a stationary induction apparatus main body including:

an iron core having at least two legs; and a winding individually wound around each of the legs, wherein the stationary induction apparatus main body is accommodated in the main body tank;

an insulating cooling medium is sealed in the main body tank, and the stationary induction apparatus main body is immersed in the insulating cooling medium;

the iron core is fastened and fixed with an upper iron-core fastener and a lower iron-core fastener;

an insulating winding support is provided between the upper iron-core fastener and the winding and between the lower iron-core fastener and the winding, the insulating winding support being in contact with and covering an inner surface of the upper iron-core fastener and an inner surface of the lower iron-core fastener;

an electrostatic shield ring is provided on at least one of an upper end part and a lower end part of the winding;

the winding and the electrostatic shield ring are fixed with the insulating winding support and at least one of the upper iron-core fastener and the lower iron-core fastener;

a magnetic ring configured of a magnetic substance is provided inside the electrostatic shield ring;

the electrostatic shield ring is configured in a manner that a conductive layer is provided to cover the magnetic ring;

the conductive layer is configured using a conductive tape being wound around the magnetic ring; and in winding the conductive tape, an insulating tape having a width equal to or greater than a width of the conductive tape is laid on an inner side of the conductive tape, and the insulating tape and the conductive tape are wound together.

2. The stationary induction apparatus according to claim 1, wherein a gap is provided at at least one place in a circumferential direction of the magnetic ring.

3. The stationary induction apparatus according to claim 2, wherein the conductive tape is electrically connected to the upper end part or the lower end part of the winding and to the magnetic ring.

4. The stationary induction apparatus according to claim 3, further comprising a plurality of insulating rings provided inside the electrostatic shield ring, the plurality of insulating rings being configured to vertically fix the magnetic ring.

5. The stationary induction apparatus according to claim 2, wherein a winding direction of the conductive tape is inverted at at least one place; and in winding the inverted conductive tape, an insulating tape having a width equal to or greater than a width of the conductive tape is laid on an inner side of the conductive tape, and the insulating tape and the conductive tape are wound together.

6. A stationary induction apparatus comprising:

a main body tank; and a stationary induction apparatus main body including:

an iron core having at least two legs; and a winding individually wound around each of the legs, wherein the stationary induction apparatus main body is accommodated in the main body tank;

an insulating cooling medium is sealed in the main body tank, and the stationary induction apparatus main body is immersed in the insulating cooling medium;

the iron core is fastened and fixed with an upper iron-core fastener and a lower iron-core fastener;

an insulating winding support is provided between the upper iron-core fastener and the winding and between the lower iron-core fastener and the winding;

an electrostatic shield ring is provided on at least one of an upper end part and a lower end part of the winding;

the winding and the electrostatic shield ring are fixed with the upper iron-core fastener or the lower iron-core fastener and the winding support;

a magnetic ring configured of a magnetic substance is provided inside the electrostatic shield ring;

the electrostatic shield ring is configured in a manner that a conductive layer is provided to cover the magnetic ring;

the conductive layer is configured using a conductive tape being wound around the magnetic ring; and in winding the conductive tape, an insulating tape having a width equal to or greater than a width of the conductive tape is laid on an inner side of the conductive tape, and the insulating tape and the conductive tape are wound together;

wherein the conductive tape is electrically connected to the upper end part or the lower end part of the winding and to the magnetic ring.

7. The stationary induction apparatus according to claim 6, wherein a gap is provided at at least one place in a circumferential direction of the magnetic ring.

8. The stationary induction apparatus according to claim 6, further comprising a plurality of insulating rings provided inside the electrostatic shield ring, the plurality of insulating rings being configured to vertically fix the magnetic ring.

9. The stationary induction apparatus according to claim 7, further comprising a plurality of insulating rings provided inside the electrostatic shield ring, the plurality of insulating rings being configured to vertically fix the magnetic ring.

10. The stationary induction apparatus according to claim 6, wherein a winding direction of the conductive tape is inverted at at least one place; and in winding the inverted conductive tape, an insulating tape having a width equal to or greater than a width of the conductive tape is laid on an inner side of the conductive tape, and the insulating tape and the conductive tape are wound together.

11. The stationary induction apparatus according to claim 7, wherein a winding direction of the conductive tape is inverted at at least one place; and in winding the inverted conductive tape, an insulating tape having a width equal to or greater than a width of the conductive tape is laid on an inner side of the conductive tape, and the insulating tape and the conductive tape are wound together.

12. The stationary induction apparatus according to claim 8, wherein a winding direction of the conductive tape is inverted at at least one place; and in winding the inverted conductive tape, an insulating tape having a width equal to or greater than a width of the conductive tape is laid on an inner side of the conductive tape, and the insulating tape and the conductive tape are wound together.

13. The stationary induction apparatus according to claim 9, wherein a winding direction of the conductive tape is inverted at at least one place; and in winding the inverted conductive tape, an insulating tape having a width equal to or greater than a width of the conductive tape is laid on an inner side of the conductive tape, and the insulating tape and the conductive tape are wound together.

14. A stationary induction apparatus comprising:

a main body tank; and a stationary induction apparatus main body including:

an iron core having at least two legs; and a winding individually wound around each of the legs, wherein the stationary induction apparatus main body is accommodated in the main body tank;

an insulating cooling medium is sealed in the main body tank, and the stationary induction apparatus main body is immersed in the insulating cooling medium;

the iron core is fastened and fixed with an upper iron-core fastener and a lower iron-core fastener;

an insulating winding support is provided between the upper iron-core fastener and the winding and between the lower iron-core fastener and the winding;

an electrostatic shield ring is provided on at least one of an upper end part and a lower end part of the winding;

the winding and the electrostatic shield ring are fixed with the upper iron-core fastener or the lower iron-core fastener and the winding support;

a magnetic ring configured of a magnetic substance is provided inside the electrostatic shield ring;

the electrostatic shield ring is configured in a manner that a conductive layer is provided to cover the magnetic ring;

the conductive layer is configured using a conductive tape being wound around the magnetic ring; and in winding the conductive tape, an insulating tape having a width equal to or greater than a width of the conductive tape is laid on an inner side of the conductive tape, and the insulating tape and the conductive tape are wound together; and further comprising a plurality of insulating rings provided inside the electrostatic shield ring, the plurality of insulating rings being configured to vertically fix the magnetic ring.

15. The stationary induction apparatus according to claim 14, wherein a gap is provided at at least one place in a circumferential direction of the magnetic ring.

16. The stationary induction apparatus according to claim 14, wherein a winding direction of the conductive tape is inverted at at least one place; and in winding the inverted conductive tape, an insulating tape having a width equal to or greater than a width of the conductive tape is laid on an inner side of the conductive tape, and the insulating tape and the conductive tape are wound together.

17. The stationary induction apparatus according to claim 15, wherein a winding direction of the conductive tape is inverted at at least one place; and in winding the inverted conductive tape, an insulating tape having a width equal to or greater than a width of the conductive tape is laid on an inner side of the conductive tape, and the insulating tape and the conductive tape are wound together.

* * * * *